US011505912B2

(12) United States Patent
Kovalick et al.

(10) Patent No.: US 11,505,912 B2
(45) Date of Patent: Nov. 22, 2022

(54) MOTOR GRADER CIRCLE DRAWBAR DEBRIS REMOVER

(71) Applicant: Caterpillar Inc., Peoria, IL (US)

(72) Inventors: Benjamin J. Kovalick, Decatur, IL (US); Lankesh Kumar Mathur Shanmukappa, Decatur, IL (US); Nathaniel K. Harshman, Sullivan, IL (US); Bruce R. Vahling, Urbana, IL (US)

(73) Assignee: Caterpillar Inc., Peoria, IL (US)

( * ) Notice: Subject to any disclaimer, the term of this patent is extended or adjusted under 35 U.S.C. 154(b) by 607 days.

(21) Appl. No.: 16/591,872

(22) Filed: Oct. 3, 2019

(65) Prior Publication Data

US 2021/0102355 A1 Apr. 8, 2021

(51) Int. Cl.

| | |
|---|---|
| ***E02F 3/76*** | (2006.01) |
| ***E02F 3/84*** | (2006.01) |
| ***E02F 3/80*** | (2006.01) |

(52) U.S. Cl.

CPC ..... *E02F 3/764* (2013.01); *E02F 3/80* (2013.01); *E02F 3/844* (2013.01)

(58) Field of Classification Search

CPC ... E02F 3/80; E02F 3/844; E02F 3/764; E02F 3/7636; E02F 3/7645; E02F 3/765; E02F 3/7654

See application file for complete search history.

(56) References Cited

U.S. PATENT DOCUMENTS

| | | | | |
|---|---|---|---|---|
| 3,015,261 | A | 1/1962 | Macdonald | |
| 4,015,669 | A * | 4/1977 | Cole | E02F 3/80 74/606 R |
| 5,408,814 | A | 4/1995 | Milbourn et al. | |
| 5,667,020 | A * | 9/1997 | Palmer | E02F 3/765 74/448 |
| 5,720,353 | A * | 2/1998 | Wilkening | E02F 3/8157 172/795 |
| 8,464,803 | B2 * | 6/2013 | Greuel | E02F 3/765 172/795 |
| 8,869,910 | B2 * | 10/2014 | Greuel | E02F 3/844 172/792 |
| 2003/0000114 | A1 | 1/2003 | Thomas | |
| 2008/0110650 | A1 * | 5/2008 | Martin | E02F 9/2275 172/667 |

(Continued)

FOREIGN PATENT DOCUMENTS

| | | |
|---|---|---|
| CN | 205592354 U | 9/2016 |
| CN | 104891161 B | 3/2017 |

(Continued)

*Primary Examiner* — Jamie L McGowan

(57) ABSTRACT

In accordance with one or more aspects, a circle drawbar for a motor grader has a drawbar frame having two elongated members, and a circle frame that has a surface defined by an inner and outer diameter. The circle frame has a circle gear located radially inward of the inner diameter, allowing the circle frame to be rotatable relative to the drawbar frame around an axis of the circle gear. A platform having a top, bottom, and an edge depends from the drawbar frame and covers the circle gear. A debris remover is connected to the platform and removes debris from the surface of the circle frame as the circle frame rotates.

20 Claims, 5 Drawing Sheets

(56) References Cited

U.S. PATENT DOCUMENTS

| | | | | |
|---|---|---|---|---|
| 2011/0247846 | A1* | 10/2011 | Greuel | E02F 3/844<br>172/781 |
| 2012/0073890 | A1* | 3/2012 | Bindl | E02F 3/764<br>180/374 |
| 2015/0135866 | A1* | 5/2015 | Staade | F16H 57/029<br>74/89.18 |
| 2019/0112782 | A1* | 4/2019 | Gundupalli | E02F 3/764 |
| 2020/0385954 | A1* | 12/2020 | Kovalick | E02F 3/844 |
| 2021/0355652 | A1* | 11/2021 | Yamaguchi | E02F 3/7645 |

FOREIGN PATENT DOCUMENTS

| | | | |
|---|---|---|---|
| FR | 2736370 | B1 | 9/1997 |
| JP | 05652014 | B2 | 1/2015 |

* cited by examiner

MOTOR GRADER CIRCLE DRAWBAR DEBRIS REMOVER

TECHNICAL FIELD

The present disclosure generally relates to motor graders, and more particularly, relates to circle drawbars for motor graders.

BACKGROUND

The grading operations which can be carried out with a motor grader are diverse. Motor graders can be employed, for example, to level or cut down a slope to provide a flat tract or can also be used to cut roads along a desired course. This versatility stems from the design and construction of the motor grader, including a wide three-dimensional positioning of a plow, and more specifically, a moldboard. The moldboard, carried on a circle drawbar, can be rotated 360 degrees in a horizontal plane, and can be tilted forwardly or rearwardly relative to a horizontal plane, and along with the circle frame it is mounted, be tilted to the left and to the right to dispose the moldboard at an angle.

A motor grader typically has a circle drawbar that comprises a drawbar frame and a circle frame. The circle frame is connected to the drawbar frame for rotation relative to the drawbar frame about an axis of a circle gear located on the circle frame. A moldboard can be mounted on the circle frame for rotation with the circle frame about the axis. A circle drive is mounted to a platform on the drawbar frame, and a pinion passes through an aperture of the platform to drive the rotation of the circle frame via the circle gear.

Traditionally, the circle frame is connected to the drawbar frame by use of shoes. The shoes are mounted to the drawbar frame and extend under the circle gear to support the circle gear for rotation on the bearing/wear inserts of the shoes. Recently, slewing bearings have been used to attach the circle to the drawbar frame, where the slewing bearing has an inner and outer ring and the drawbar frame is connected to the outer ring and the inner ring is the circle gear.

However, the circle drawbars that utilize slewing bearings to connect the drawbar frame and the circle frame require tight tolerances and can be damaged when debris contaminates the bearing. Further, a gap is often required between the rotating interface of the drawbar and circle frame due to manufacturing tolerances and to allow rotation. This gap can allow debris to enter and interfere with hoses, the circle gear, and the slewing bearing.

U.S. Patent Publication No. 2015/0135866, entitled Sealed Guard for Motor Grader Draft Apparatus, provides for a motor grader draft apparatus that has a draft frame, a circle, a moldboard, a circle drive, a guard, and a seal. The circle is connected to the draft frame for rotation of the circle relative to the draft frame. The guard depends from the draft frame so as to provide radial cover of the circle gear, and a seal establishes a sealed connection between the guard and the circle.

However, there is still a need for an effective way to remove debris and prevent it from entering in the interface of the drawbar frame and the circle frame.

SUMMARY

In accordance with one aspect of the present disclosure, a circle drawbar for a motor grader is disclosed. The circle drawbar includes a drawbar frame, circle frame, a platform, and a debris remover. The drawbar frame is made of two elongated members, and the circle frame has an inner and outer diameter defining a surface. A circle gear is located radially inward of the inner diameter allowing the circle frame to be rotatable relative to the drawbar frame about an axis of the circle gear. The platform depends from the drawbar frame and radially covers the circle gear. The debris remover is connected to the platform and removes debris off of the surface of the circle frame when it rotates about the axis.

In a further aspect, a motor grader is provided. The motor grader is constructed of a front frame and a rear frame. The front frame is supported on a pair of front wheels connected to a main support frame, and the rear frame is supported on right a right and left tandem set of rear wheels. The motor grader further includes a moldboard and a circle drawbar attached to the front frame, the circle drawbar includes a drawbar frame, a circle frame, a platform, and a debris remover. The drawbar frame is made of two elongated members and the circle frame has a surface that is defined by an inner and outer diameter. The circle gear is located radially inward of the inner diameter. A platform depends from the drawbar frame and radially covers the circle gear, and has a top, bottom, and an edge. The debris remover is connected to the platform and is used to engage the surface of the circle frame as the circle frame rotates about an axis of the circle gear to remove debris off of the surface of the circle frame.

In yet another aspect of the present disclosure, a method of operating a motor grader is provided. The method includes providing a motor grader that has a circle drawbar. The circle drawbar has a drawbar frame formed of two elongated members and a circle frame that is has a surface defined by an inner and outer diameter. The circle frame further has a circle gear located radially inward of the inner diameter, and a platform that depends form the drawbar frame. The platform has a top, bottom, and an edge. The method further includes rotating the circle frame relative to the drawbar frame about an axis of the circle gear to remove debris from the surface of the circle frame with a debris remover attached to the platform as the circle frame rotates.

These and other aspects and features of the present disclosure will be more readily understood when read in conjunction with the accompanying drawings.

DETAILED DESCRIPTION

The following detailed description is directed to technologies for motor graders. Motor graders are large machines that often have a circle frame, attached underneath a front frame, which is utilized to rotate a moldboard to level or cut roads. In some implementations of the present disclosure, various debris removers and methods are used to prevent debris from disrupting a motor grader's circle drawbar rotational abilities.

References are made to the accompanying figures that form a part hereof, and which are shown by way of illustration, specific embodiments, or examples. Like numerals represent like elements through the several figures.

Figure 1:
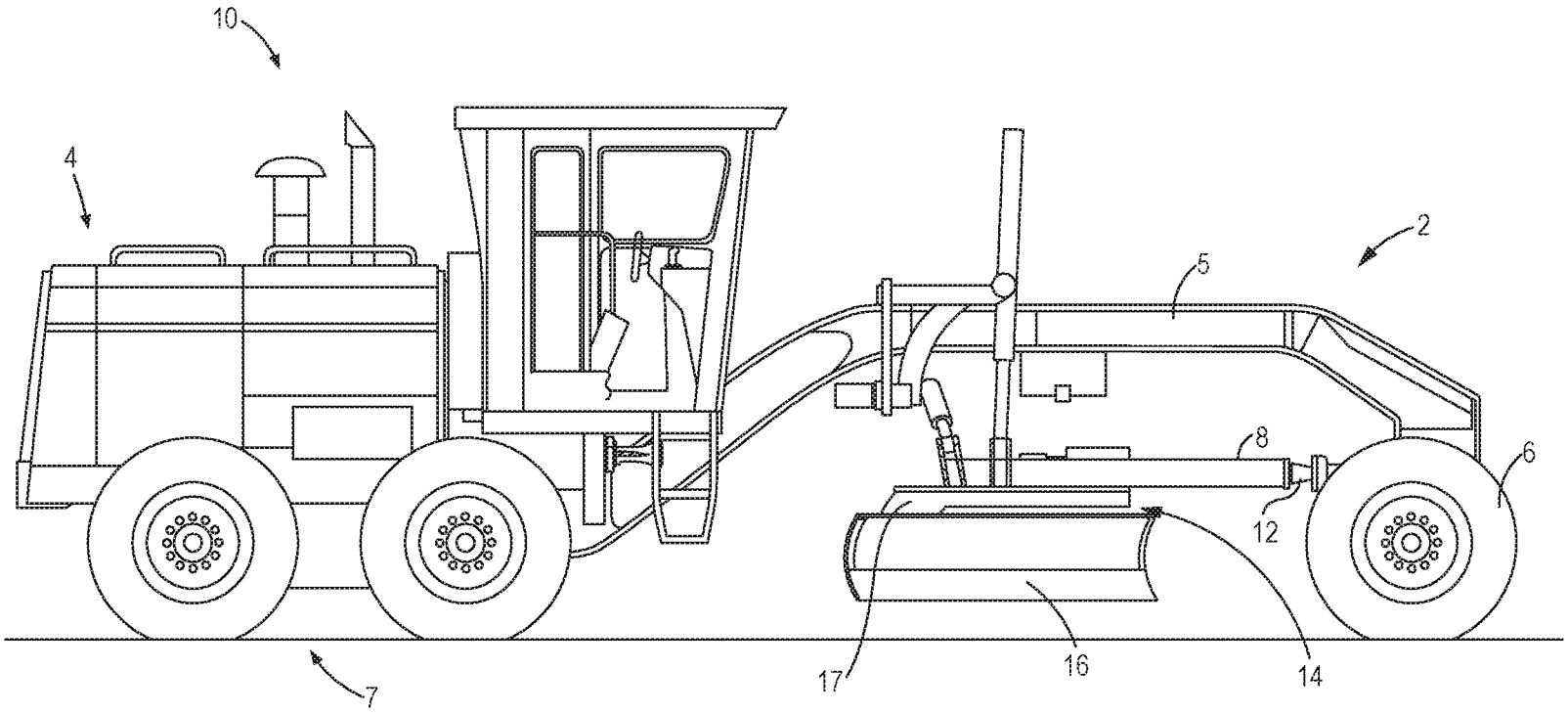
FIG. 1 is a side view of a motor grader constructed in accordance with the present disclosure.

Referring now to the figures, and with specific reference to FIG. 1, a motor grader 10 including front and rear fame 2 and 4, respectively, is shown with the front frame 2 being supported on a pair of front wheels 6 connected to the main support frame 5 of the front frame 2, and the rear frame 4 being supported on right and left tandem set of rear wheels 7. Connected to the front frame 2 is the drawbar frame 8, which connects to the front frame 2 at a connection point 12, such as a ball joint or other connection means. The drawbar frame 8 is connected to the circle frame 14, which in combination with the drawbar frame 8 defines the circle drawbar (reference number 20 of FIG. 2).

In operation, the circle frame 14 is rotatable with regards to the drawbar frame 8, and includes a moldboard 16 attached to the circle frame 14 by the tool support 17. This allows the moldboard 16 to be rotated by the circle frame 14, relative to the drawbar frame 8, without having to change the directional movement of the motor grader 10.

Figure 2:
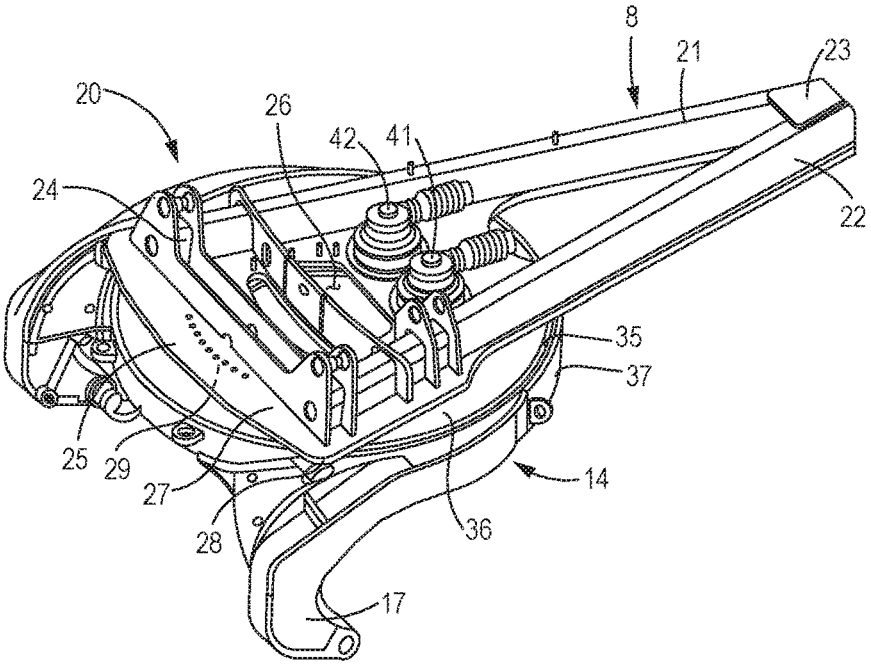
FIG. 2 is a perspective view of a circle drawbar, in accordance with one embodiment of the present disclosure.

The circle drawbar 20 for a motor grader 10 is shown in more detail in FIG. 2. As depicted, the circle drawbar 20 has a drawbar frame 8 and a circle frame 14. The drawbar frame 8 is meant to couple the circle drawbar 20 to a motor grader's main frame 2 via, for example, a spherical joint (or other connection point 12) at a front end 23 of the drawbar frame 8. The circle frame 14 is connected to the drawbar frame 8 for rotation relative to the drawbar frame 8 about an axis.

In one embodiment, the drawbar frame 8 has a first and a second elongated member 21 and 22, respectively, that are connected at one end to form the front end 23 of the drawbar frame 8. Both elongated members 21, 22, at a rear end 24 of the drawbar frame 8, are connected to a platform 25. In the FIG. 1 embodiment, the platform 25 runs the entire length of the drawbar frame 8, but in other embodiments the platform is long enough to cover an aperture 26 defined by an interior diameter 34 (as shown in FIG. 2) to protect the interior of the circle frame 14. The platform has a top surface 27, an edge 28 forming the shape of the platform 25, and a bottom surface 29. The circle 10 has an inner diameter 34 (as shown in FIG. 2) and an outer diameter 35, a top surface 36, and a side surface 37. In one embodiment, the side surface 37 extends perpendicularly from the outer diameter 35. As shown in FIG. 1, a tool support 17 can be mounted to the circle frame 14 to allow for mounting of a tool, such as the moldboard (as shown as reference number 16 in FIG. 1). A moldboard is a type of plow, sometimes a curved metal plow, used to plow and level earthly materials such as soil. The tool attached to the tool support 17 rotates with the circle frame 14, relative to the drawbar frame 8, when the circle frame 14 is rotated.

Figure 3:
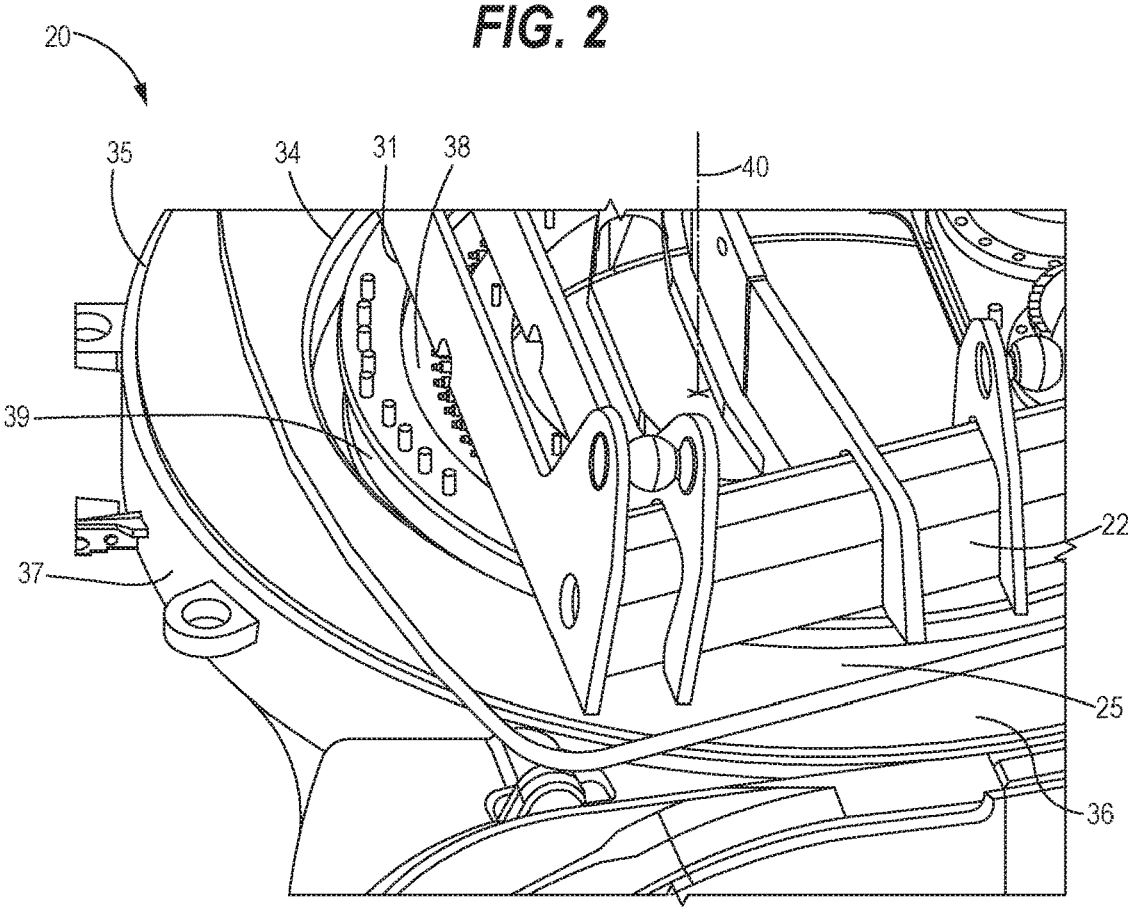
FIG. 3 is an enlarged perspective view showing the interior of the circle frame as shown in FIG. 2.

Turning to FIG. 3, is a perspective view detailing the interior of the circle drawbar 20, as shown in FIG. 2. In FIG. 2 the circle frame 14, a circle gear 38, an outer ring 39, the second elongated member 22, the inner diameter 34 and the outer diameter 35 of the circle frame 14, the top surface 36 and the side surface 37 of the circle frame 14, the platform 25, and an axis 40 of the circle gear 14 are shown.

The circle frame 14 includes the circle gear 38 in order to rotate the circle frame 14 around an axis 40 of the circle gear 38. In operation, a first circle drive motor 41, and in one embodiment, a second circle drive motor 42, are mounted on top of the platform 25. The circle drive motors 41, 42, together or independently can drive one or more pinion (not shown), that is rotated by the circle drive motors 41, 42. In this embodiment, the pinion passes through an aperture (not shown) of the platform 25 and engage with the circle gear 38. Since the circle drive motors 41, 42, are mounted onto the platform 25 and the circle gear 38 is attached to the circle frame 14, the circle frame 14 is rotatable relative to the drawbar frame 8 about the axis 40 of the circle gear 38.

In a further embodiment, the circle frame 14 includes a slewing bearing 31. In this embodiment, the slewing bearing 31 is formed of the outer ring 39, and the circle gear 38 located radially inward of the outer ring 39 (relative to the axis of said circle gear 38), and ball bearings (not shown) are located between the outer ring 39 and the circle gear 38. In this embodiment, the outer ring 39 is mounted to the circle frame 14, and more specifically, the platform 25, and the circle gear 38 is connected to the circle frame 14.

In order to provide a view of a gap 33, FIG. 3 provides a magnified side view of the front portion, nearest the second elongated member 22, of the circle drawbar 20 as shown in FIG. 2. The circle frame 14 is shown with its side surface 37 and top surface 36 along with the platform 25 and the second elongated member 22 of the drawbar frame 8. To allow for rotation of the circle frame 14 relative to the drawbar frame 8, the gap 33 exist in between the surface 36 of the circle frame 14 and the platform 25, and more specifically, the bottom surface 29 of the platform 25.

Figure 5:
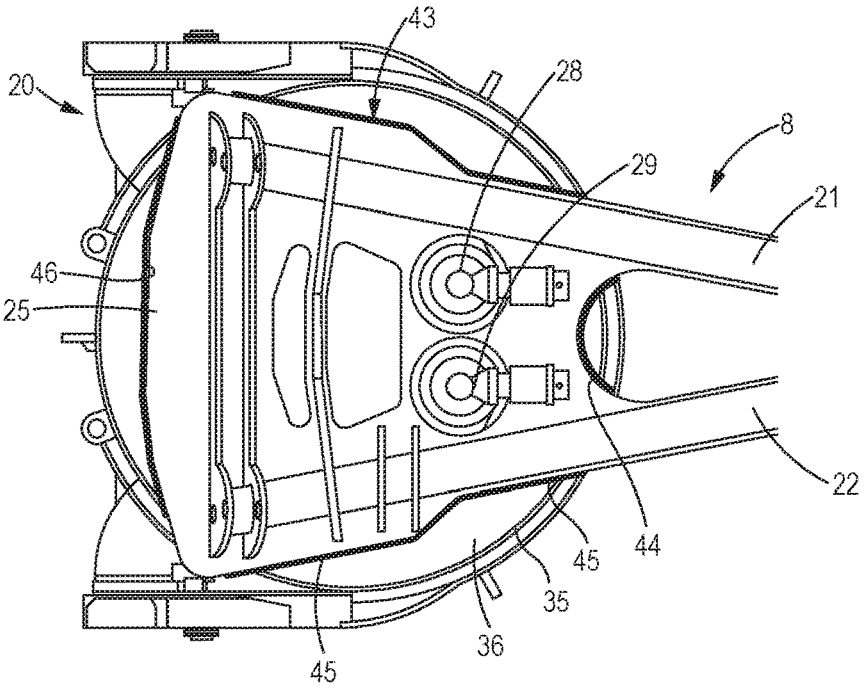
FIG. 5 is a top view of the circle drawbar of FIG. 2 having attached debris removers, in accordance with an embodiment of the present disclosure.

Best shown in FIG. 5, in order to prevent debris from entering into the gap 33 outlined above, the circle drawbar 20 may include a first side debris remover 43, a front side 44 debris remover, a second side debris remover 45, or a rear side debris remover 46. The circle frame 14, the drawbar frame 8, the top surface 36, the outer diameter 35, the platform 25, the first and second circle drive motors 28, 29, the first and second elongated members 21, 22, are also shown.

In one embodiment, the first and second side debris removers 43, 45, the back debris remover 46, and the front debris remover 44 are located on the sides, back, and front edges 28 of the platform 25 respectively. In one embodiment, the first and second side 43, 45, front 44, or back 46 debris removers can be one piece, and in another embodiment, multiple debris removers 43, 44, 45, 46 can be used. For example, in FIG. 5, the second side debris remover 45 is shown as one elongated piece, but in another embodiment, two or more debris removers 45 can be used to cover the side edge 28 of the platform 25.

Figure 4:
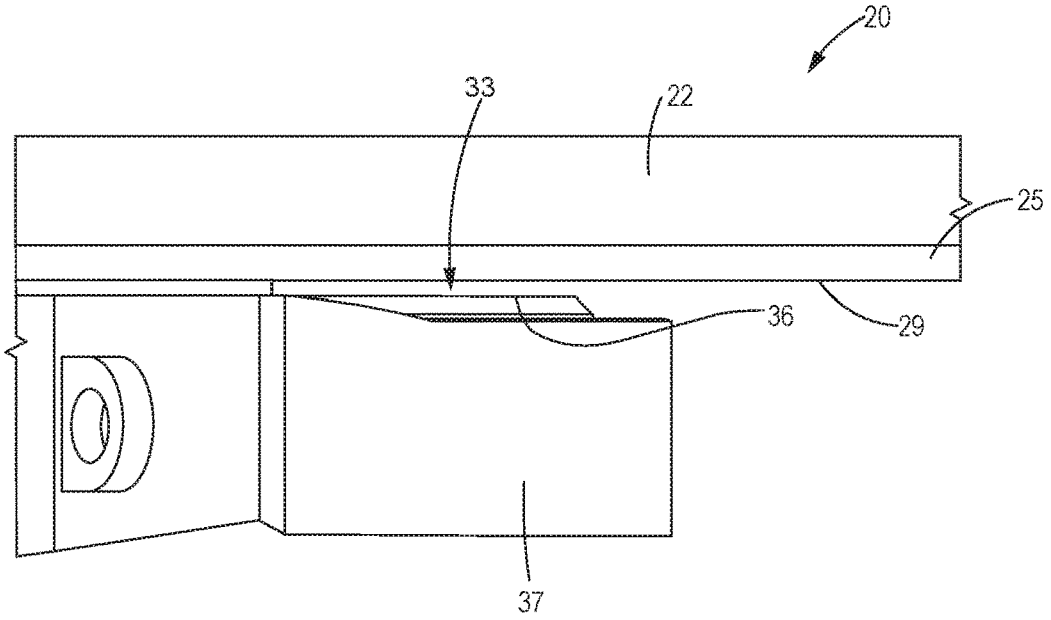
FIG. 4 is enlarged side view of the front portion of the circle frame as shown in FIG. 2.

During operation, dirt or other debris can enter in between the gaps of the circle's surface 36 and the platform 25, such as gap 33 shown in FIG. 4. This debris can interfere with the slewing bearing 31, the circle gear 38, or other components located inside of the circle such as hydraulic tubing (no shown). Accordingly, to avoid this from happening, in one embodiment, the debris remover, such as the first side debris remover 43, the front side debris remover 44, the second side debris remover 45, or the back side debris remover 46, is a brush that attaches to the top surface 27, or the edge 28, of the platform 28 and is configured to brush debris off of the surface 36 of the circle frame 14 as the circle frame 14 rotates relative to the drawbar frame 8. In this embodiment, as the circle frame 14 rotates around the axis 40 of the circle gear 38, the above-mentioned debris removers 43, 44, 45, 46 brush the debris off of the surface 36 and prevent the debris from entering into the gap 33 between the platform 25 and the top surface 36 of the circle frame 14.

In one embodiment, the debris remover, such as the first side debris remover 43, the front side debris remover 44, the second side debris remover 45, or the back side debris remover 46, is a scraper that attaches to the top surface 27, or the edge 28, of the platform 28 and is configured to scrape debris off of the surface 36 of the circle frame 14 as the circle frame 14 rotates relative to the drawbar frame 8. In this embodiment, as the circle frame 14 rotates around the axis 40 of the circle gear 38, the above-mentioned debris removers 43, 44, 45, 46 brush the debris off of the surface 36 and prevent the debris from entering into the gap 33 between the platform 25 and the top surface 36 of the circle frame 14.

Figure 6:
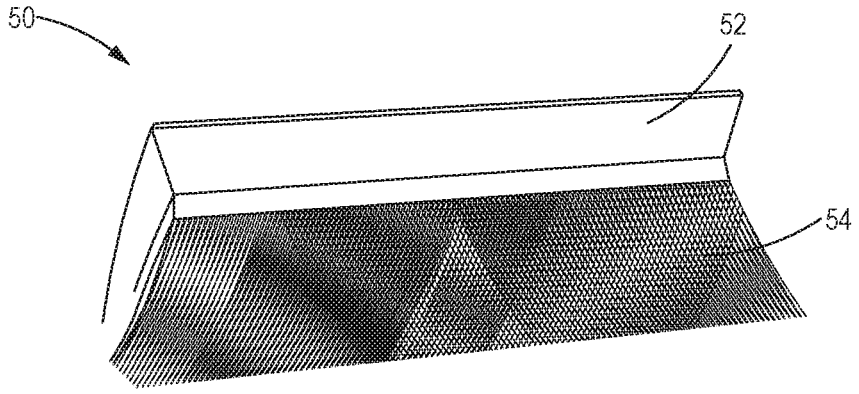
FIG. 6 is a perspective view of a debris remover in accordance with one embodiment of the present disclosure.

A debris remover 50 is shown in more detail in FIG. 6. In one embodiment, the debris remover 50 includes the attachment piece 52 and the brush 54. In another embodiment, the debris remover 50 can be the first or second side debris remover 43, 45, the back debris remover 46, or the front debris remover 44 of FIG. 5. In other embodiments, the attachment piece 52 can clip onto the edge 28 of the platform 25, be attached to the by an adhesive or another attachment means, or be attached to the top surface 27 of the platform 25 by a bolt. In a further embodiment, the attachment piece 52 is a strip that is slidably attachable, or attachable by an adhesive or other means, to the edge of the platform 12. In an exemplary embodiment, the attachment piece 52 can attach to the first or second elongated members 21, 22, of the drawbar frame 8 or at another part of the platform 25.

The brush 54 can be manufactured from a variety of materials, for example, the brush 54 can be made from metallic materials such as aluminum, brass, steel, or from non-metallic materials such as but not limited to rubber or some form of plastic including polycarbonate. In one non-limiting embodiment, durable materials such as metallic brushes or tougher rubbers and plastics are used to make the brush 54 due to the tougher environments in which motor graders are used. Further, the brush 54 may be positioned vertically or horizontally with respects to the direction of travel of the brush 54 with respects to the edge 28 of the platform 25.

Figure 7:
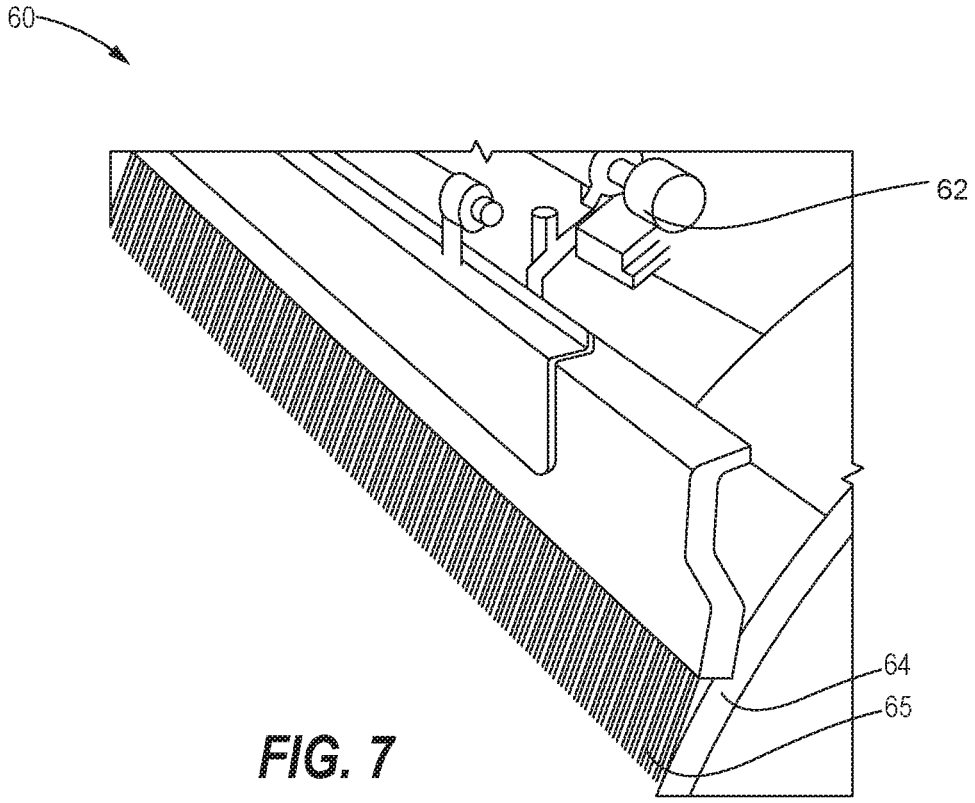
FIG. 7 is a perspective view of a debris remover in accordance with one embodiment of the present disclosure.

The debris remover 60, as depicted in FIG. 7, may remove debris by scraping. In this embodiment, the attachment piece 62 and the scraper 64 are shown. The FIG. 6 embodiment of the debris remover 60 can be used as the first or second side debris remover 43, 45, the back debris remover 46, or the front debris remover 44 shown in FIG. 5.

In the debris remover 60 embodiment of FIG. 6 the attachment piece 62 is adjustable, relative to the platform 25, to allow the angle of the scraper 64 to be changed and to adjust the scraper 64 down as the scraper 64 is worn down over time to cover the gaps 33. The adjustability of the attachment piece 62 also allows for a user to adjust the scraper 64 to account for different gap 33 heights. For example, a gap between the top surface 36 and the platform 25 may be 10 mm at the back side of the platform 25 but 15 mm at the front side of the platform 25. In this example, the front side debris remover 44 would need to be adjusted down to account for the larger gap between the surface 36 and the platform 25, relative to the back side debris remover 46. The height and adjustable attachment piece 62 can be used as the attachment piece with the debris remover 50 having a brush, such as brush 54 in FIG. 6, as well.

The scraper 64 can also be manufactured from a variety of materials. For example non-metallic, metallic, rubber, or forms of hard plastic may all be used. In one embodiment, the scraper 64, after being height adjusted, engages the top surface 36 of the circle frame 14, or may be close to engaging the surface 36, to allow the scraper 64 to scrape off debris as the circle frame 14 rotates relative to the drawbar frame 8. The embodiment of FIG. 7 includes brushes 65 to assist the scraper 64 in removing debris off of surface 36 of the circle 14, but other embodiments do not include the brush 65. In operation, if debris is sitting on the surface 36, as the circle frame 14 is rotated, the scraper 64 will scrape off the debris as the surface 36 of the circle frame 14 is rotated underneath the platform 25, thus preventing debris from entering into any gaps (such as gap 33) between the platform 25 and the surface 36.

INDUSTRIAL APPLICABILITY

In general, the teachings of the present disclosure may find applicability in various different work machine applications. For instance, the circle drawbars having debris removers disclosed herein may be utilized on motor graders or any other large machinery that utilizes circle drawbars. It is appreciated that in addition to being manufactured with these debris removers, many existing work machines having circle drawbars may be retrofitted with the debris removes disclosed herein. As such, it is to be appreciated that any debris removers for circle drawbars may be delivered to customers in a kit for assembly and installation on existing circle drawbars to prevent debris from entering any gaps between the drawbar frame and the circle.

Figure 8:
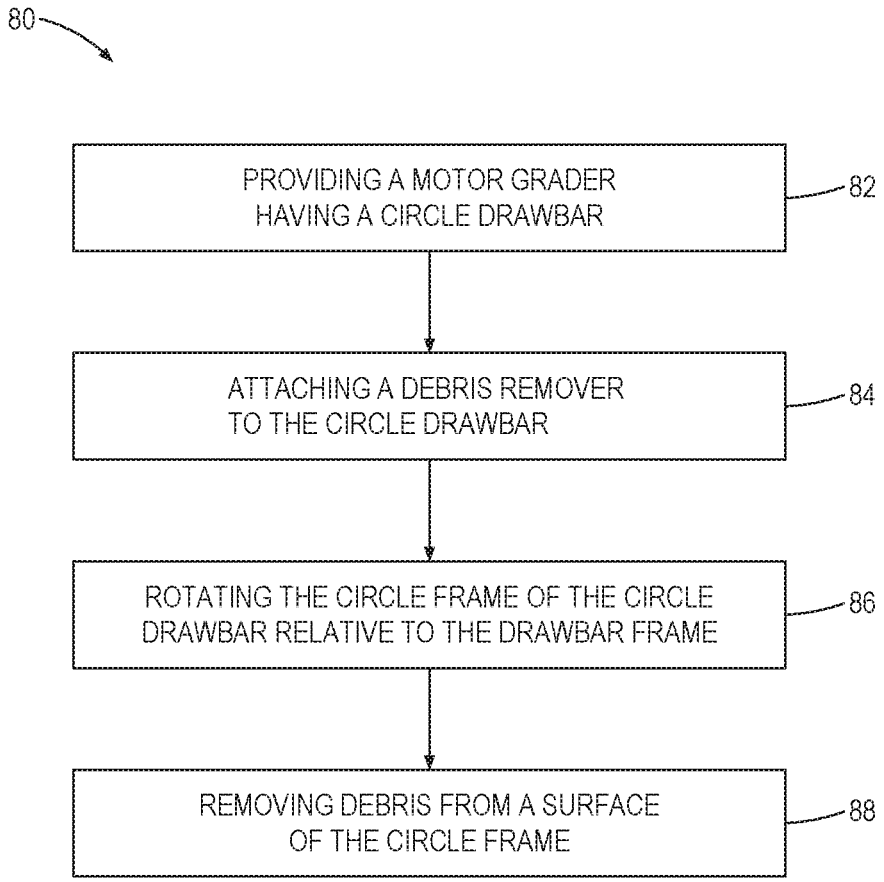
FIG. 8 is a flowchart depicting a sample sequence of steps which may be practiced according to a method of the present disclosure.

In one example, the method of operating a motor grader 80, best depicted by the flow chart in FIG. 8, may be utilized with any motor graders having a debris remover, and is applied by way of example to the circle drawbar 20 depicted in FIG. 5. In particular, FIG. 8 depicts the method 80 that includes the first block 82, providing a motor grader 10 having a circle drawbar 20. As shown above, the circle drawbar 20 includes a circle frame 14 and a drawbar frame 8. The circle frame 14 has a surface 36 that is defined by an inner diameter 34 and an outer diameter 35. The drawbar frame 8 is made of a first and second elongated member 21, 22, and the platform 25, having the top surface 27, the edge 28, and the bottom surface 29, depends from it.

In the second block 84, the attaching a debris remover 43, 44, 45, 46 to the circle drawbar 46, by a user of the method 80, is performed. This step may not need to be performed, and it is optional if, the circle drawbar 20 already has any of the desired attached debris removers 43, 44, 45, 46 attached to the platform 25 of the circle drawbar 20. For example, if the circle drawbar 20 depicted in FIG. 5 already has attached first and second side debris removers 43, 45, the front side debris remover 44, and the back side debris remover 46 attached to the platform 46, there would be no need to perform this step. However, in other examples, the motor grader 10 may not have come with a circle drawbar 20 with permanent or pre-attached debris removers 43, 44, 45, 46 and they must be attached. Further, this step may include the need to adjust the height of the any debris remover 43, 44, 45, 46, as outlined above.

Motor graders work in extremely tough conditions where the machine gets covered in dirt and debris. Gaps, such as gap 33, exist between the circle frame 14 and the drawbar frame 8, specifically the platform 25 depending from the drawbar frame 8, due to tolerances in manufacturing as well as to allow the circle frame 14 to rotate relative to the drawbar frame 8. Due to these gaps and the tough conditions the motor graders work in, the debris can enter the gaps and damage seals, hoses, the circle gear, and the slewing bearing.

Returning to the discussion of the method 80, the present discloser solves this problem by including a first and second side debris removers 43, 45, the back debris remover 46, and the front debris remover 44 are added in order to scrape or brush debris off of the surface 36 of the circle frame 14 as the circle frame 14 rotates relative to the drawbar frame 8 in block 86. These debris removers 43, 44, 45, 46 attach to the edge 28, or top surface 27, of the platform 25, to prevent debris from entering the gaps. By preventing debris from entering the gaps, such as gap 33, removing the debris from the surface 36 of the drawbar frame 20, and more specifically off of the surface 36 of the circle frame 14, in block 88, the maintenance cost of the motor grader 10 can be lowered and its service life extended by preventing debris from jamming the interior gears or damaging components.

While the preceding text sets forth a detailed description of numerous different embodiments, it should be understood that the legal scope of protection is defined by the words of the claims set forth at the end of this patent. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims defining the scope of protection.

It should also be understood that, unless a term was expressly defined herein, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to herein in a manner consistent with a single meaning, that is done for sake of clarity only so as to not confuse the reader, and it is not intended that such claim term be limited, by implication or otherwise, to that single meaning.

What is claimed is:

1. A circle drawbar for a motor grader, comprising:

a drawbar frame having two elongated members;

a circle frame comprising an inner and outer diameter, a surface between said inner and outer diameter, and a circle gear located radially inward of the inner diameter, the circle frame being rotatable relative to the drawbar frame about an axis of the circle gear;

a platform having a top surface, a bottom surface, and an edge, the platform depending from the drawbar frame and radially covering the circle gear; and a debris remover connected to the platform to remove debris off of the surface of the circle frame when the circle rotates about the axis, wherein the debris remover includes an attachment piece and the attachment piece is connected to the edge or the top surface of the platform, and wherein the debris remover further has a brush and is configured to remove debris by brushing debris off the surface of the circle frame as the circle frame rotates.

2. The circle drawbar of claim 1, further including a tool support connected to the circle frame for rotation therewith about the axis, the tool support configured to attach a moldboard.

3. The circle drawbar of claim 2, further including a circle drive mounted on the platform and including a pinion passing through an aperture in the platform and engaging the circle gear, the circle drive configured to rotate the circle and the tool frame about the axis.

4. The circle drawbar of claim 1, wherein the brush is arranged in a horizontal orientation, relative to the edge of the platform.

5. The circle drawbar of claim 1, wherein the debris remover further has a scraper and is configured to remove debris by scraping debris off the surface of the circle frame as the circle frame rotates.

6. The circle drawbar of claim 5, wherein the debris remover engages the surface of the circle when scraping off debris.

7. The circle drawbar of claim 1, wherein the attachment piece is a metal strip that is attached to the edge of the platform.

8. The circle drawbar of claim 1, wherein the debris remover is connected to a first portion of the platform where the edge is proximal the surface of the circle, and a second portion of the platform extends radially away from the circle.

9. The circle drawbar of claim 1, wherein the drawbar frame is connected to the top surface of the platform.

10. The circle drawbar of claim 1, wherein the circle frame further includes a slewing bearing, having an outer ring and an inner ring radially inward of the outer ring relative to the axis, the outer ring being mounted to the drawbar frame, the inner ring including the circle gear and being rotatable about the axis relative to the outer ring, the inner ring being mounted to the circle.

11. The circle drawbar of claim 10, wherein the debris remover is configured to remove debris on the surface of the circle as the circle rotates to prevent debris from entering between an opening between the inner diameter of the circle frame and the outer ring of the slewing bearing.

12. The circle drawbar of claim 11, further comprising a second debris remover on a front edge of the platform located between the two elongated members.

13. The circle drawbar of claim 1, wherein the attachment piece is connected to the edge of the platform.

14. The circle drawbar of claim 1, wherein the attachment piece is connected to the top surface of the platform.

15. A motor grader, comprising:

a front frame supported on a pair of front wheels connected to a main support frame of the front frame;

a rear frame supported on a right and left tandem set of rear wheels;

a moldboard;

a circle drawbar connected to the front frame, the circle drawbar further comprising:

a drawbar frame formed of two elongated members, a circle frame that includes a surface defined by an inner and outer diameter, a circle gear located radially inward of the inner diameter, a platform depending from the drawbar frame and radially covering the circle gear, the platform having a top and bottom surface and an edge; and a debris remover connected to the platform, the debris remover configured to engage the surface of the circle frame as the circle frame rotates about an axis of the circle gear, the debris remover removing debris as the circle frame rotates, wherein the debris remover is a brush that attaches to the platform.

16. The motor grader of claim 15, wherein the debris remover further includes a scraper that attaches to the edge of the platform, and is configured to remove debris by scraping debris off the surface of the circle frame as the circle frame rotates.

17. The motor grader of claim 15, wherein the debris remover is connected to the edge of the platform.

18. A method of operating a motor grader, comprising:

providing a motor grader having a circle drawbar, the circle drawbar including:

a drawbar frame formed of two elongated member, a circle frame including an inner and outer diameter, a surface between said inner and outer diameters, and a circle gear located radially inward of the inner diameter, a platform depending from the drawbar frame, the platform having a top, bottom, and an edge;

rotating the circle frame relative to the drawbar frame around an axis of the circle gear; and removing debris from the surface of the circle frame with a debris remover attached to the platform as the circle rotates, wherein the debris remover is a brush attached to the edge or top of the platform.

19. The method of claim 18, wherein the debris remover further includes a scraper attached to the edge or top of the platform.

20. The method of claim 18, wherein the debris remover is attached to the edge of the platform.

* * * * *